United States Patent [19]

Johnson

[11] 4,269,330

[45] May 26, 1981

[54] CARTRIDGE TYPE SAUCE EXTRUDER

[76] Inventor: Terry J. Johnson, One E. Schiller, Chicago, Ill. 60611

[21] Appl. No.: 83,620

[22] Filed: Oct. 11, 1979

[51] Int. Cl.[3] ..... B67D 5/42

[52] U.S. Cl. ..... 222/386; 222/541; 222/490; 222/494

[58] Field of Search ..... 222/386, 387, 388, 389, 222/390, 391, 326, 327, 541, 490, 494, 498

[56] References Cited

U.S. PATENT DOCUMENTS

| | | | |
|---|---|---|---|
| 1,989,714 | 2/1935 | Statham | 222/490 |
| 3,076,573 | 2/1963 | Thomas | 222/498 X |
| 3,420,417 | 1/1969 | Kardel | 222/390 |
| 3,442,424 | 5/1969 | Prussin et al. | 222/541 X |
| 3,917,124 | 11/1975 | Kifer | 222/386 |
| 4,169,547 | 10/1979 | Newell | 222/386 |

FOREIGN PATENT DOCUMENTS

| | | | |
|---|---|---|---|
| 69878 | 8/1949 | Denmark | 222/386 |

*Primary Examiner*—Allen N. Knowles
*Attorney, Agent, or Firm*—Richard A. Zachar

[57] ABSTRACT

A one-piece dispenser cartridge of the type having an extrusion orifice at one end and open at the other end to receive a movable bottom plug, which is adapted to be displaced inwardly toward said orifice by the plunger of a suitable holder and thus to extrude the contents of the cartridge in selected quantities, wherein the movable bottom plug is contoured to expel virtually all of the contents and wherein the orifice is sealed with a disc which is pre-scored or pre-cut to form a multi-segmented nozzle when extrusion pressure is exerted thereagainst.

19 Claims, 13 Drawing Figures

FIG. 1
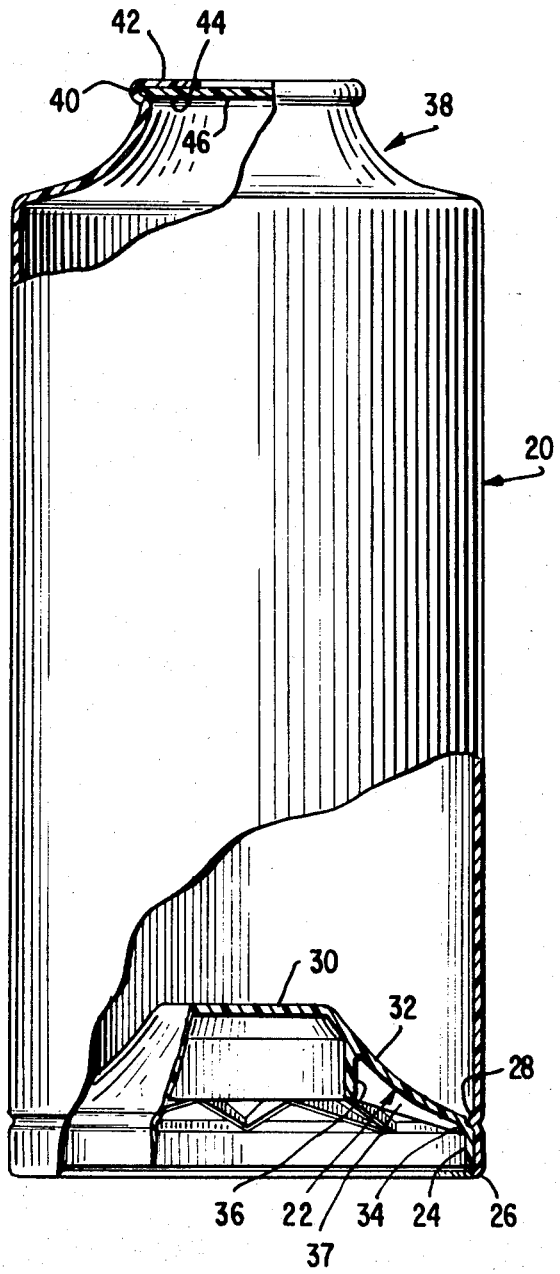
FIG. 2
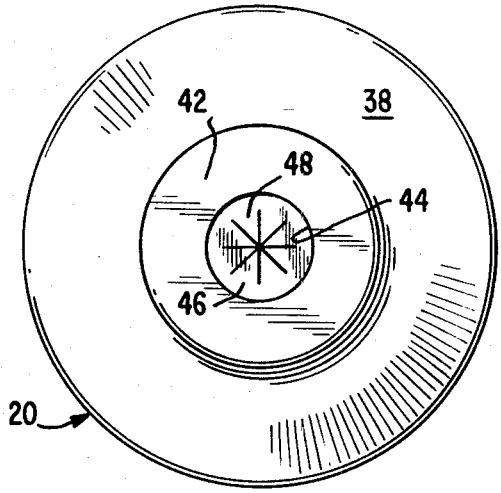
FIG. 3
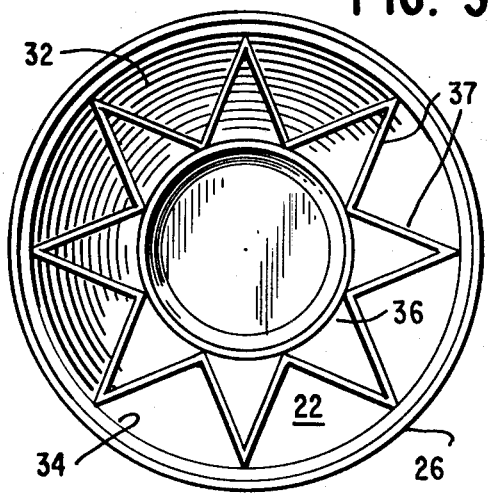
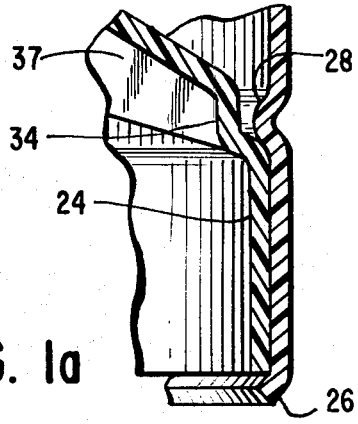
FIG. 1a

FIG. 4
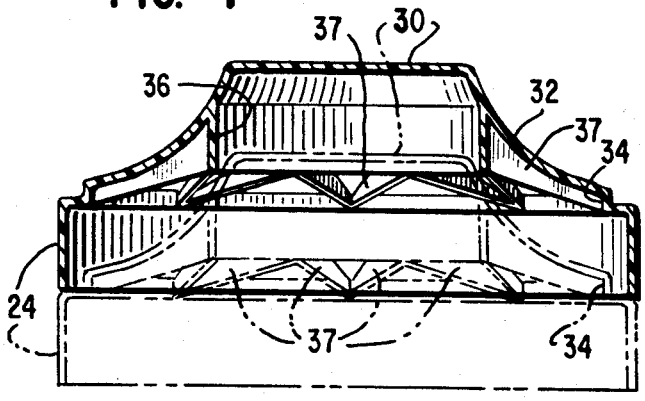
FIG. 6
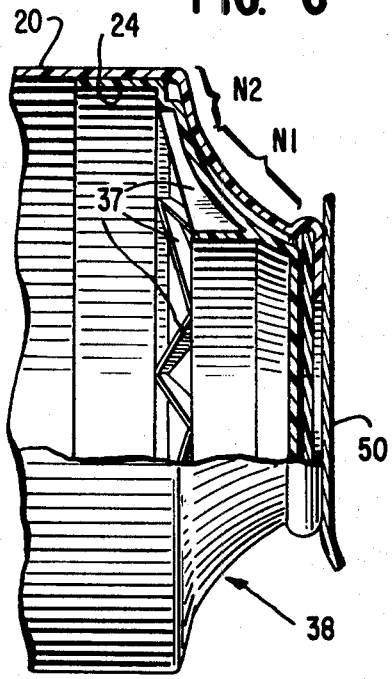
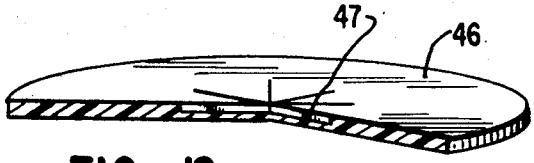
FIG. 12
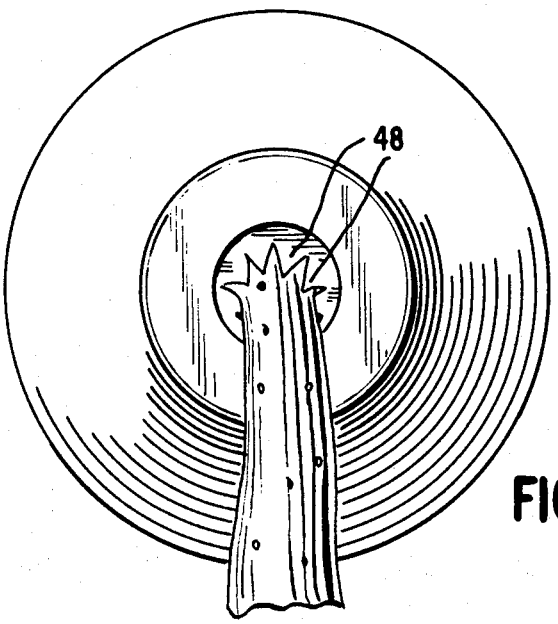
FIG. 5

FIG. 7
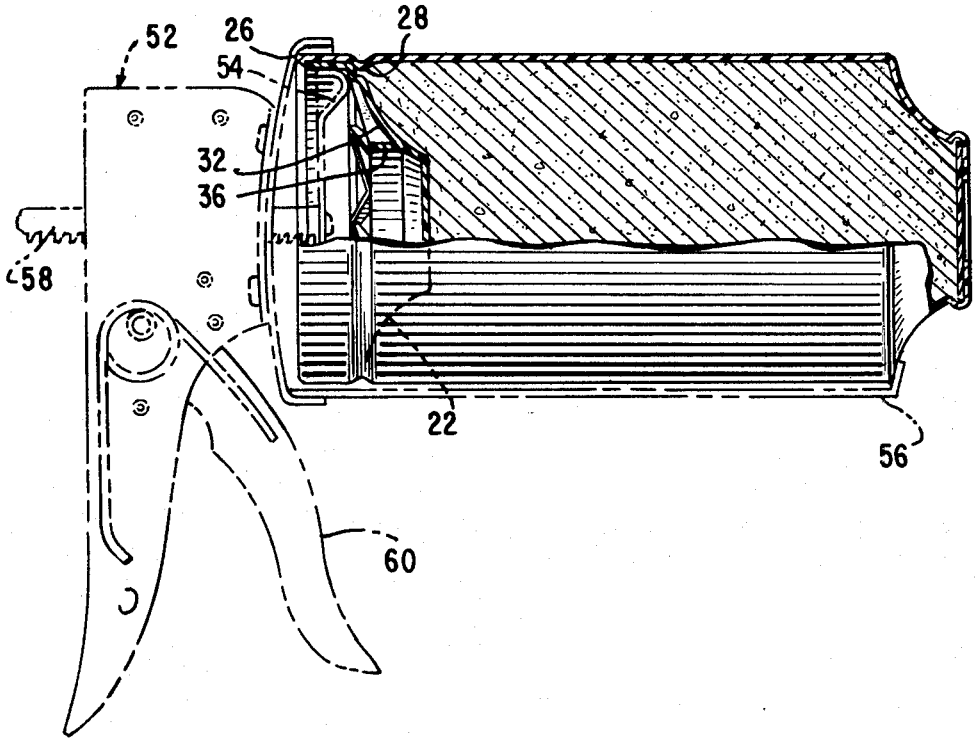
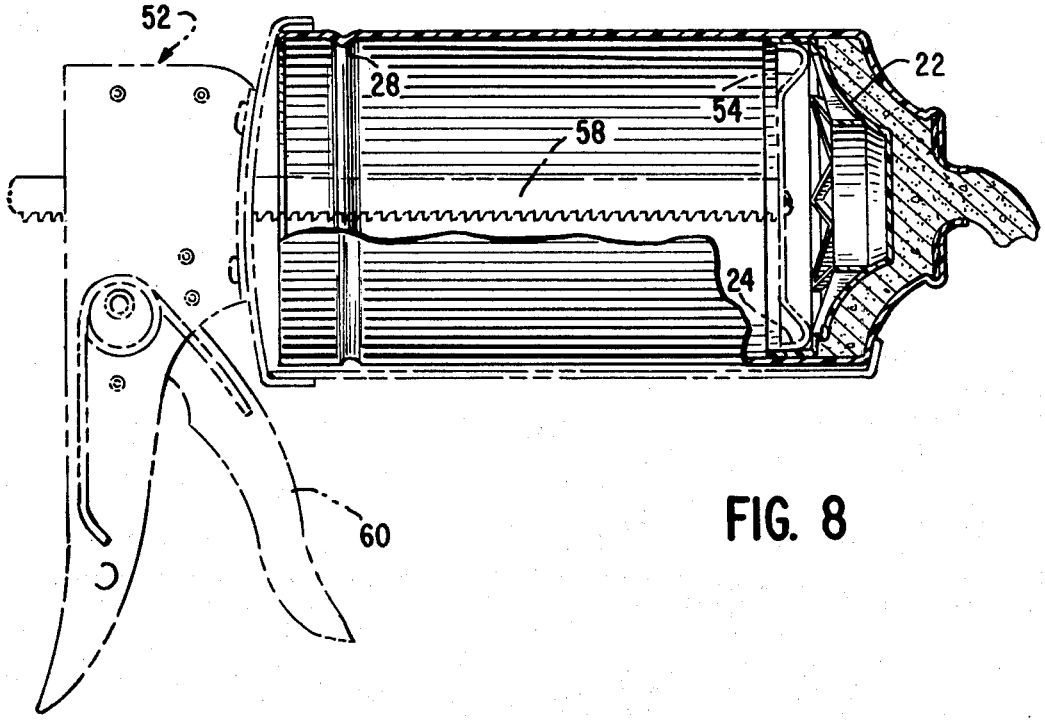
FIG. 8

20
22
66
64
50
50
50
20

CARTRIDGE TYPE SAUCE EXTRUDER

My invention relates to a cartridge of the type used to extrude selected quantities of relatively thick sauces and similar viscous products, such as the proprietary sauces developed by certain fast food franchise organizations for use with hamburger sandwiches served in their stores and restaurants.

BACKGROUND OF THE INVENTION

Cartridges of the type to which my invention relates have been known and used for many years in various industries. In the construction industry, for example, it is well known to market caulking compounds and similar putty-like or semi-solid materials in cylindrical cartridges that have protruding nozzles at one end, through which the contents may be extruded in continuous lengths. The material so extruded has a cross-sectional form and dimension corresponding to the orifice through which it is extruded. Such cartridges are adapted to be placed in a holder with a propellable-repellable plunger at one end, the plunger being operable to exert pressure on a bottom member or plug of the cartridge. The bottom plug is axially retractable within the cylindrical body of the cartridge and is adapted to be pushed by the plunger toward the nozzle end of the cartridge. Such plungers are usually operable by a trigger and ratchet mechanism which enables the user, by squeezing the trigger, to move the bottom plug of the cartridge any selected distance toward the other end thereof and thus to cause a pre-determined quantity of the cartridge contents to be extruded through the nozzle. In other similar cartridge holders, the plunger is connected to a screw mechanism which may be operated by a rotatable handle or crank to exert pressure on the movable bottom plug of the cartridge. Typically, the ratchet mechanism can exert pressure up to 400 $lbs/in^2$.

In the kitchens of fast food restaurants, there is a need for utensils and dispensers which provide maximum speed, convenience and quantity control. Such utensils and dispensers must, of course, meet the highest sanitary standards. Also, it is essential that maximum uniformity be maintained in sauces served by restaurants of the same franchisor, whereever they are located. Cartridge dispensers have been found to fulfill these needs and they are being used increasingly by franchisors to make the operations at their stores and restaurants more efficient and economical.

U.S. Pat. No. 3,884,396 discloses a disposable cartridge structure comprising a cylindrical container body made of a foil-laminated, food-grade paperboard material, a separate dispensing head of molded plastic, and a separate plug of molded plastic. The head and plug are secured to the body by means of strips of shrinkable plastic heat-sealing tape. While the foregoing cartridge structure has been received with favor, it has several drawbacks which have somewhat limited its utilization. In this regard, the cartridge arrangement shown in U.S. Pat. No. 3,884,396 requires complex and expensive equipment for use in connection with the assembly and filling operations. Further, due to the multitude of parts, operational difficulties are relatively common during such operations with the result that the speed of filling and assembly cannot be maintained at the desired levels.

Difficulties have also been experienced in the shipping of the load cartridges of the type shown in the foregoing patent. Typically, the cartridges after being filled with sauce are are arranged in boxes and the boxes stacked one upon the other. Such stacking can produce up to several hundred pounds of force on some of the cartridges. The load forces create stress points at the sharply angled regions of the dispensing head sufficient to cause fracture and leakage of the contents of the cartridges.

SUMMARY OF THE INVENTION

It is a principal object of my invention to provide a dispenser type cartridge assembly which is economical to manufacture, easy to fill, and sealable to protect the contamination but which is openable at the dispensing end to form a suitable nozzle when sufficient pressure is applied to a movable bottom or plug at the opposite end.

It is another object of my invention to prevent accidental extrusion of the cartridge contents by incorporating means to resist unintended displacement of the piston-like movable plug.

It is a further object of my invention to enable the extrusion of virtually all of the contents from the cartridge so as to minimize the waste that would otherwise occur if any appreciable amount of product were trapped in the cartridge.

It is a still further object of my invention to maintain the highest sanitary standards by sealing the nozzle and bottom or plug ends of the cartridge so as to prevent any contact with foreign matter during shipment and storage.

Additionally, it is an object of my invention to develop an improved design for the bottom (or plug or plunger) portion of the cartridge assembly, which enables readily-separable stacking of the plugs or plunger for shipment purposes, and one which provides structural reinforcement thereof during use as a part of the assembly.

A dispensing cartridge assembly in accordance with the invention includes a hollow, generally cylindrical cartridge body for holding the product to be discharged, a discharge control disc, and a plunger unit axially slidably received within the body. In one embodiment the body comprises a unitary structure having a first axial length section of substantially uniform inside diameter terminating at one end of the body, and a second axial length section extending from the first length section to the other end of the body. The second axial length section includes a generally cone shaped neck portion having its minor inner diameter region adjacent such other end. A transversely extending body closure wall portion defines the aforesaid other end and is provided with a central orifice opening in alignment with the axis of the body. An annular retainer wall portion joins the closure wall portion and the aforesaid minor inner diameter region, and interiorly defines snap-fit receiving seat means for supporting said discharge control disc in adjacent parallel relation to said closure wall portion.

The foregoing structure provides improved sealing at the nozzle end of the cartridge assembly, eliminates need for gluing to seat the discharge control disc, and permits boxes filled cartridge assemblies to be stacked without damage or leakage due to vertical load forces being exerted at the nozzle end region.

A plug or plunger unit is provided comprising a body that includes a substantially flat transverse wall portion and a generally cone shaped portion terminating at said wall portion. The cone shaped portion has its minor outer diameter region adjacent said wall portion and it is of slightly less dimension than the minor inner diameter region of the neck portion of the body. This effects wedging cooperation between the cone shape portion of the plunger unit and the cone shaped neck portion when the plunger has moved to the nozzle end of the assembly thereby enabling a squeezing action tending to cause substantially all the product to be discharged from the body.

The plug or plunger unit includes a generally cylindrical portion of substantially axially uniform outside diameter (of a diameter substantially equal to the inside diameter of the first axial length portion of the cartridge body) that is outwardly radially offset from the cone shaped portion thereof and connected therewith by a substantially transverse wall section. The junction of the wall section and the cylindrical portion is rounded to define an annular bead or cam surface. The first axial length section of the cartridge body includes axially spaced inwardly projecting bulges or beads adjacent the bottom or open end thereof to respectively engage the axial extremeties of the cylindrical portion of the plunger unit. When the plunger is initially inserted within the cartridge body, the bead or cam surface of the plunger outwardly displaces the first of the beads of the cartridge body. Upon further insertion, the cam surface engages the second bead of the cartridge body and slightly outwardly displaces it. Simultaneously, the opposite axial extremity of the cylindrical portion of the plunger unit axially passes the first bead thereby permitting it to spring-back. The second bead thereupon acts on the cam surface of the plunger unit to force it axially back thereby effecting snap-fit, self-seating of the unit between the two beads within the cartridge body.

The foregoing arrangement affords, in addition to proper self-seating of the plunger, proper self-sealing engagement (requiring no external seals) and a firm lock to prevent rocking of the plunger or dislodgement thereof from the cartridge body.

The cartridge body is preferrably of a material of substantially more limited memory than that of the plug or plunger unit, but which has substantially the same coefficient of expansion and contraction. In the illustrated embodiments polyethylene was chosen for the cartridge body and polypropylene was chosen for the plug. The foregoing characteristics of the materials enables the cartridge assembly to resist deflection upon dropping of the cartridge assembly at the plug end region, which would otherwise cause spillage of the contents.

In one embodiment the discharge control disc is prescored rather than pre-cut to eliminate the need for a separate nozzle end seal. Such disc structure can be made as a separate unit, or as an integral part of the cartridge nozzle portion.

Other features and advantages of the invention will be apparent from the following description and claims, and are illustrated in the accompanying drawings which show structure embodying preferred features of the present invention and the principles thereof, and what is now considered to be the best mode in which to apply these principles.

BRIEF DESCRIPTION OF THE DRAWINGS

FIG. 1 is a side view, partly in section, showing a cartridge assembly embodying my invention with the movable plug portion seated therein;

FIG. 1*a* is a detailed view in section showing the peripheral portion of a plug member or plunger unit engaged in the cooperating seat at the bottom of the cartridge body;

FIG. 2 is a top view of the cartridge assembly;

FIG. 3 is a bottom view thereof showing the movable plug seated in the open lower end of the cartridge body;

FIG. 4 is a side view in section showing the plug or plunger units stacked as during storage or shipment;

FIG. 5 is a top view of the extrusion or nozzle end of the cartridge assembly with seal removed to show the extrusion disc during extrusion;

FIG. 6 is a view partly in section of the nozzle end of the cartridge assembly, showing the plug fully propelled into engagement therewith;

FIG. 7 is a view similar to FIG. 1, but showing the cartridge engaged with a holder which can be operated to extrude the contents;

FIG. 8 is similar to FIG. 7 but showing the plug disposed adjacent the top portion of the cartridge;

FIG. 12 is a perspective view, partly in section, showing a pre-scored discharge control disc.

Figures 9, 10, 11:
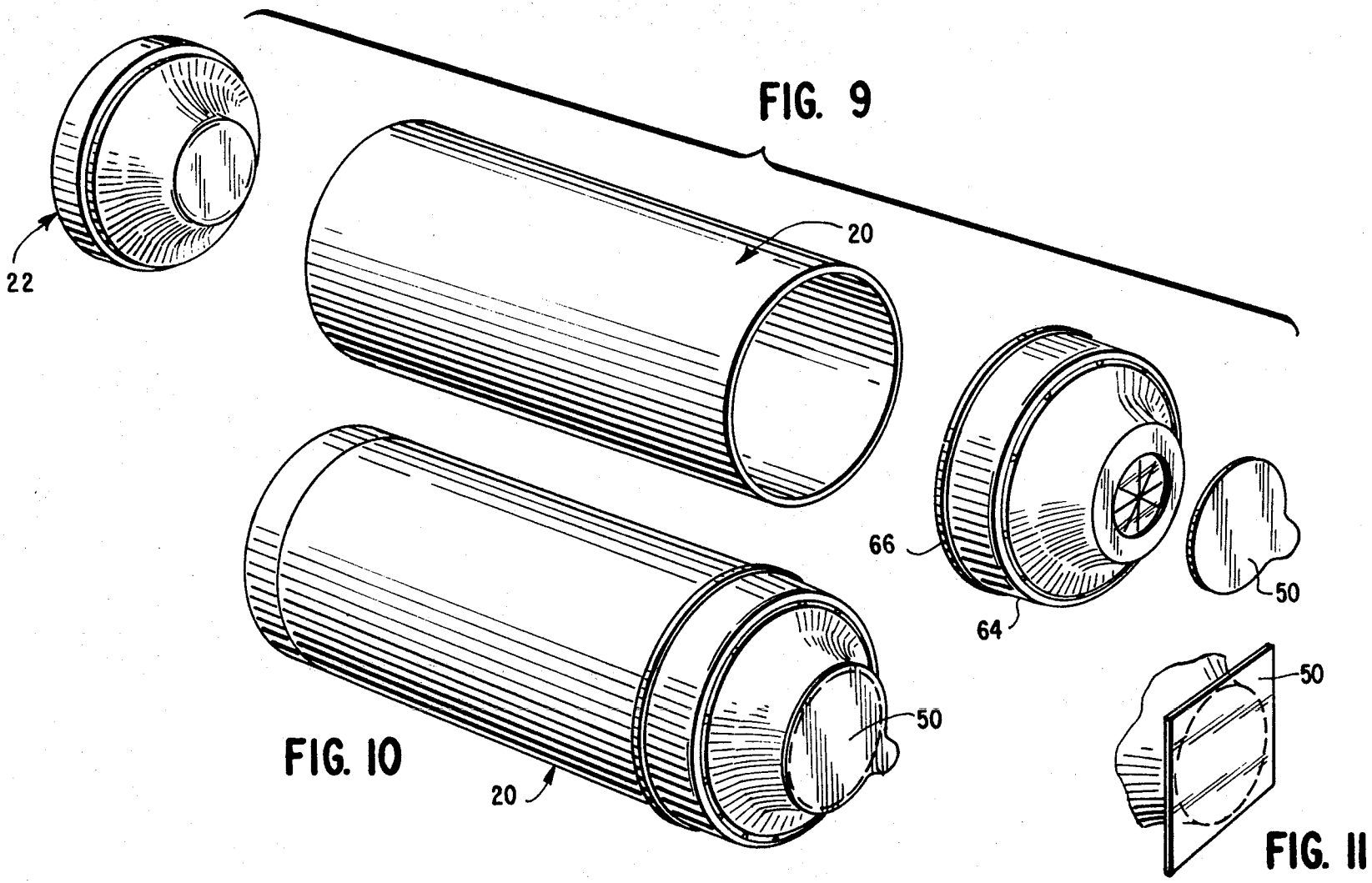
FIG. 9 is an exploded view of a modified form of cartridge assembly of FIG. 9 in assembled form.
FIG. 10 is a perspective view of the cartridge assembly of FIG. 9 in assembled form.
FIG. 11 shows an alternative form of sanitary seal at the extrusion end of the cartridge assembly.

Referring to the drawings, a cartridge assembly in accordance with the invention is shown in one form in FIG. 1 to comprise a one-piece molded body indicated generally by the reference numeral 20. At one end, the body is open to receive a molded plastic bottom plug or plunger 22, which is generally frusto-conical in form, with a downwardly depending peripheral skirt 24. The cylindrical body 20 is provided at its open end with a slightly inturned perpheral portion or bead 26 and a circumferential bead 28, axially spaced from said peripheral portion 26 a distance corresponding to the width of the depending skirt 24 so as to provide a seat for engaging the skirt 24. The circumferential bead 28 is dimensioned to resist accidental displacement of the plug 22 when subjected to pressures up to about 80 pounds per square inch, such as might be applied in normal or even careless handling of the cartridge assembly. In a preferred form, the circumferential bead 28 has a radius of about 0.030 inch. The preferred spacing between the bead 28 and the peripheral portion or bead 26 is approximately ½ inch. The plug 22 has a substantially planar circular center panel 30, with an outwardly depending annular cone-like portion 32 which is slightly "dished" for cooperation with the extrusion end of the cartridge, as hereinafter explained. The annular cone portion 32 is joined to the skirt 24 with a stepped offset wall portion 34. On its underside, said annular cone portion 32 of the plug 22 is provided with a downwardly depending cylindrical flange 36 of slightly greater diameter than the center panel 30. For purposes of adding structural strength, a plurality of ribs 37 radiate in star-shaped configuration outwardly from the flange 36 to the wall portion 34.

At its top or extrusion end, the body 20 is provided with a somewhat "dished" annular neck portion 38 which tapers inwardly and upwardly to a circumferential bulge or seat 40, and an annular end wall 42 which forms a circular orifice 44. The bulge 40 provides an internal seat adjacent the annular end wall 42, to receive a plastic disc 46, which is cut with radial slits as shown in FIGS. 2 and 5 for form a plurality of triangular segments 48.

In the presently preferred embodiment disclosed herein the cartridge body is preferably made of plastic material by a blow molding process such as is disclosed in U.S. Pat. No. 3,211,347. A satisfactory cartridge can be made of such plastic with a wall thickness of 0.040 inch. As shown in FIG. 6, a region N1 of the neck 38 is formed with a radius of curvature of 0.956 inch; a neck region N2 is formed to subtend an angle (measured from the transverse) of 12½°; the circumferential bulge or seat 40 is formed with a radius of curvature equal to 0.080 inch; an outside diameter of the cylindrical portion of the body 20 of 3.210 inches; a diameter of the end wall 42, excluding the circumferential seat 40, of 1.456 inch; a diameter of the orifice opening 44 of 0.750 inch; an overall length of the cartridge body of 7.475 inches; a length of the cartridge neck portion of 0.750 inches; and a distance between peripheral portion 26 and the circumferential bead 28 of 0.050 inch. Peripheral portion 26 extends inwardly a distance of 0.030 inch while the bead 28 is formed of a radius of 1/16 inch.

As best shown in FIG. 6, the annular cone portion 32 of the plug or plunger unit 22 and the neck portion 38 are similarly contoured, except that the neck portion 38 rises slightly more steeply toward the annular end wall 42 than the cone portion 32, the purpose being to cause initial contact therebetween at their corresponding outer peripheries. As further pressure is applied to squeeze the plunger unit 22 against the neck 38, a wedging engagement is achieved that tends to squeeze substantially all the contents from the cartridge assembly.

In use, a cartridge of the type shown herein is open at the bottom in order to be filled with a quantity of the product to be dispensed therein. At the time of filling, the orifice 44 is closed with a piece of impervious film-like material such as polyethylene film to form a seal 50 as shown in section in FIG. 6, and as shown in FIGS. 10 and 11 in connection with a modified form of cartridge, to protect the disc 46 from contact with any contaminants.

After the cartridge has been filled, the plunger unit 22 is pressed into seating engagement with the open end of the cylindrical body 20. The body 20, being molded of somewhat yieldable polyethylene, enables the in-turned portion or bead 26 to distend outwardly sufficiently to permit the plug 22 to be inserted. With reference to FIG. 1*a* it will be noted that the junction of wall portion 34 of the plunger unit with skirt 24 is rounded to define a bead or cam surface. Upon further insertion, the cam surface engages bead 28 and displaces it radially outwardly. Simultaneously the free end of the skirt 24 axially passes bead 26, allowing the latter to snap-back. Thereupon, bead 28 presses against the cam surface thereby to cause the plunger unit to "pop" back and self-seat between the beads 26, 28. The circumferential bead 28 prevents accidentally pressing the plug 22 therebeyond.

Referring to FIGS. 7 and 8, the filled cartridge is shown in combination with a holder 52, indicated by broken lines. Such holders are well known in the art, the one shown herein being of the trigger and ratchet type wherein a piston or plunger 54 is adapted to bear against the plug 22. A support 56 is adapted to engage the neck portion 38 of the cartridge remote from the plunger 54. An elongated ratchet member 58 has suitable, longitudinally disposed teeth and is engaged at one end with the plunger 54. A spring-loaded handle or trigger can be operated to advance the plunger 54 in successive incremental steps, toward the dispensing end of the cartridge. Holders 52 of this type will exert pressure up to 400 pounds or more per square inch, which overrides the resistance of the bead 28 to displacement of the plug 22 and exerts the desired pressure on the contents of the cartridge.

After the cartridge has been inserted in the holder 52, the seal 50 is removed, and when sauce is to be extruded, the trigger 60 is squeezed to cause the elongated ratchet 58 to advance the plunger 54 and thereby to exert pressure upon the plug 22 with which it is engaged, so as to propel said plug 22 toward the dispensing end of the cartridge. As pressure is increased on the contents of the cartridge, that pressure is exerted on the disc 46, causing the triangular segments 48 to yield outwardly, allowing product contained in the cartridge to be extruded—the amount extruded being determined by the amount of pressure exerted on the plug 22 by the person operating the holder 52. With a little practice, the holder 52 can be operated to extrude successive quantities of product that are substantially identical, volumetrically. When the plug 22 is pressed firmly against the shoulder portion 38, the last remaining product is squeezed toward the orifice 44 for extension.

The cylindrical flange 36 on the under side of the plug 22 serves as a spacer when plugs are stacked as best shown in FIG. 4, and facilitates removal of one plug 22 at a time from a stack, for insertion in the bottom of a cartridge body 20 after filling thereof. The flange 36 together with ribs 37 also reinforces the plug 22 and to insure that it retains its proper shape when being propelled toward the neck portion 28 of the cartridge body and when it is squeezed thereagainst to extrude residual contents. Also, the flange 36 and ribs 37 provide a convenient protrusion which can be grasped manually to remove the plug 22 from the cartridge body 20. It will be understood that the cartridges embodying my invention may be cleaned and re-used many times because they are not subjected to significant wear in the course of dispensing the semi-liquid contents.

Referring to FIGS. 9, 10 and 11, my improved dispenser cartridge is shown in a modified form wherein the top or nozzle portion 64 containing the extrusion orifice is manufactured as separate and apart from the cylindrical body 20. As shown, particularly in FIG. 9, the separate top portion 64 is provided with a downturned peripheral flange 66 which has an inside diameter substantially the same as the outside diameter of the cylindrical body 20, so that when attached thereto, the top 64 fits snugly thereupon the resists displacement. The top 64 may, of course, be secured to the body 20 by means of a suitable adhesive or, if desired, the flange 66 can be threaded internally to cooperate with corresponding threads (not shown), molded into the body 20.

With reference to FIG. 9, the disc 46 there shown differs from that previously described in that it is prescored only. The depth of the scoring is such that the pressure developed by the gun is capable of bursting the disc along the radial score lines. Such modified disc may be made as an integral part of the wall 30 of the cartridge or, as shown, as a separate unit.

From the foregoing, it can be seen that the cartridge assembly includes a generally cylindrical cartridge body 20, a discharging control disc 46, and a plunger unit 22 axially slidably received within the body 20. The assembly is further characterized in that the body 20 includes a first axial length section of substantially uniform inside diameter terminating at one end (i.e., at or near bead 26) of the body, and a second axial length section extending from the first length section to the other (i.e., nozzle) end of the body. The second length section includes a generally cone shaped neck portion 38 having its minor inner diameter region adjacent the nozzle end and a transversely extending body closure wall portion 42 defining such other (i.e., nozzle) end and having a central orifice opening 44 in alignment with the axis of the body, and an annular retainer wall portion 40 joining wall 42 and the foregoing minor diameter region of neck 38, such wall portion 40 interiorly defining snap-fit receiving seat means for supporting disc 46 in adjacent parallel relation to closure wall 42.

I have shown and described my improved dispenser cartridge in the embodiment I prefer and in one alternative embodiment, but with the contemplation of my invention, the scope of which is to be determined by the appended claims.

What is claimed is:

1. In a dispensing cartridge assembly that includes a hollow, generally cylindrical cartridge body for holding the product to be discharged, and a plunger unit axially slidably received within the body, the improvement wherein said body includes a first axial length section of substantially uniform inside diameter terminating at one end of the body, and a second axial length section extending from the first length section to the other end of the body; said second axial length section including a generally cone-shaped neck portion having its minor inner diameter region adjacent said other end and having a central orifice opening in alignment with the axis of the body, said plunger unit comprising a body that includes a cylindrically shaped first portion of substantially axially uniform outside diameter that is substantially equal to said uniform inside diameter, said first portion terminating at one end of the unit, and a generally cone-shaped portion extending from said first portion and terminating at the other end of the unit, and wherein said first axial length section of the cartridge body includes axially spaced, inwardly projecting annular bulges adjacent said one end thereof to engage said first portion of the plunger unit therebetween in snap-fit relation.

2. In a dispensing cartridge assembly in accordance with claim 1 wherein said annular bulges comprise a first bulge region defining a circumambient ring of rounded surface configuration and a second bulge region defining a circumambient ring that includes a substantially flat transverse surface portion facing said first bulge region.

3. In a dispensing cartridge assembly in accordance with claim 1 wherein the minor diameter region of the neck portion is arcuate in cross-section and the major diameter region is generally planar in cross-section.

4. In a dispensing cartridge assembly in accordance with claim 3 wherein the cartridge body is of plastic material, the arcuate neck portion defines a radius of about one inch and the planar neck portion is offset from the transverse direction by an angle of about 12½ degrees.

5. In a dispensing cartridge assembly in accordance with claim 1 wherein the cartridge body and said plunger unit are of plastic material having substantially the same coefficient of expansion, the plastic material of the cartridge body having substantially more limited memory than the plastic material of said plunger unit.

6. In a dispensing cartridge assembly in accordance with claim 1 wherein the cartridge body comprises a unitary structure.

7. In a dispensing cartridge assembly that includes a hollow, generally cylindrical cartridge body for holding the product to be discharged, and a plunger unit axially slidably received within the body, the improvement wherein said body comprises a unitary structure having a first axial length section of substantially uniform inside diameter terminating at one end of the body, and a second axial length section extending from the first length section to the other end of the body; said second axial length section including a generally cone-shaped neck portion having its minor inner diameter region adjacent said other end and a transversely extending body closure wall portion defining said other end and having a central orifice opening in alignment with the axis of the body, said plunger unit comprising a body that includes a substantially flat transverse wall portion and a generally cone-shaped portion terminating at said wall portion, said cone-shaped portion having its minor outer diameter region adjacent said wall portion of slightly less dimension than said minor inner diameter region to effect wedging cooperation between the cone-shaped portion of the plunger unit and the cone-shaped neck portion thereby effecting a squeezing action tending to cause substantially all the product to be discharged from the cartridge body, wherein the body of said plunger unit further includes a cylindrical shaped skirt portion of substantially axially uniform outside diameter that is substantially equal to said uniform inside diameter, said skirt portion terminating at one end of the unit, the cone-shaped portion of the unit extending between said skirt portion and said transverse wall portion, and wherein said first axial length section of said cartridge body includes axially spaced inwardly projecting annular bulges adjacent said one end of said cartridge body to engage said skirt portion of the plunger unit therebetween in snap-fit relation.

8. In a dispensing cartridge assembly in accordance with claim 7 wherein the cartridge body and said plunger unit are of plastic material having substantially the same coefficient of expansion, the plastic material of the cartridge body having substantially more limited memory than the plastic material of said plunger unit.

9. In a dispensing cartridge assembly that includes a hollow, generally cylindrical cartridge body for holding the product to be discharged, a discharge control disc, and a plunger unit axially slidably received within the body, the improvement wherein said body comprises a unitary structure having a first axial length section of substantially uniform inside diameter terminating at one end of the body, and a second axial length section extending from the first length section to the other end of the body; said second axial length section including a generally cone-shaped neck portion having its minor inner diameter region adjacent said other end, a transversely extending body closure wall portion defining said other end and having a central orifice opening in alignment with the axis of the body, and an annular retainer wall portion joining closure wall portion and said minor inner diameter region, said retainer wall portion interiorly defining snap-fit receiving seat means for supporting said discharge control disc in adjacent parallel relation to said closure wall portion, and wherein said plunger unit comprises a body that includes a cylindrically shaped first portion of substantially axially uniform outside diameter that is substantially equal to said uniform inside diameter, said first portion terminating at one end of the unit, and a generally cone-shaped portion extending from said first portion and terminating at the other end of the unit, and wherein said first axial length section of the cartridge body includes axially spaced inwardly projecting annular bulges adjacent said one end thereof to engage said first portion of the plunger unit therebetween in snap-fit relation.

10. In a dispensing cartridge assembly in accordance with claim 9 wherein the minor outer diameter region adjacent said wall portion is of slightly less dimension than said minor inner diameter region to effect wedging cooperation between the cone-shaped portion of the plunger unit and the cone-shaped neck portion thereby effecting a squeezing action tending to cause substantially all the product to be discharged from the body.

11. In a dispensing cartridge assembly in accordance with claim 9 wherein said annular bulges comprise a first bulge region defining a circumambient ring of rounded surface configuration and a second bulge region defining a circumambient ring that includes a substantially flat transverse surface portion facing said first bulge region.

12. In a dispensing cartridge assembly in accordance with claim 9 wherein the minor diameter region of the neck portion is arcuate in cross-section and the major diameter region is generally planar in cross-section.

13. In a dispensing cartridge assembly in accordance with claim 9 wherein the cartridge body is of plastic material, the arcuate neck portion defines a radius of about one inch and the planar neck portion is offset from the transverse direction by an angle of about 12½ degrees.

14. A plunger unit for use with a dispensing cartridge assembly that includes a hollow, generally cylindrical cartridge body for holding the product to be dispensed through an axially aligned opening located at the discharge end thereof, said cartridge body being generally cone-shaped at the discharge end region thereof, said plunger unit comprising a body that includes a cylindrically shaped first portion of substantially axially uniform outside diameter that is substantially equal to said uniform inside diameter, said first portion terminating at one end of the unit, and a generally cone-shaped portion extending from said first portion and terminating at the other end of the unit, said cone-shaped portion of the unit including a base region of axially uniform outer diameter of a dimension less than the outer diameter of said first portion, and a substantially transverse wall section connecting said base region with said first portion, the plunger body being hollow and further including an interior, generally cylindrically shaped annular rim downwardly projecting from an intermediate region of the cone-shaped portion to define plunger unit stacking support.

15. In a dispensing cartridge assembly that includes a hollow, generally cylindrical cartridge body for holding the product to be discharged, a discharge control disc, and a plunger unit axially slidably received within the body, the improvement wherein said body comprises a unitary structure having a first axial length section of substantially uniform inside diameter terminating at one end of the body, and a second axial length section extending from the first length section to the other end of the body; said second axial length section including a generally cone-shaped neck portion having its minor inner diameter region adjacent said other end, a transversely extending body closure wall portion defining said other end and having a central orifice opening in alignment with the axis of the body, and an annular retainer wall portion integrally joining the closure wall portion and said minor inner diameter region, said retainer wall portion being generally "C" shaped in cross-section to interiorly define snap-fit receiving seat means for supporting said discharge control disc in adjacent parallel relation to said closure wall portion; and wherein said plunger unit comprises a body that includes a cylindrically shaped first portion of substantially axially uniform outside diameter that is substantially equal to said uniform inside diameter, said first portion terminating at one end of the unit, and a generally cone-shaped portion extending from said first portion and terminating at the other end of the unit, and wherein said first axial length section of the cartridge body includes axially spaced inwardly projecting annular bulges adjacent said one end thereof to engage said first portion of the plunger unit therebetween in snap-fit relation.

16. In a dispensing cartridge assembly in accordance with claim 15 wherein said plunger unit comprises a body that includes a substantially flat transverse wall portion and a generally cone-shaped portion terminating at said wall portion, said cone-shaped portion having its minor outer diameter adjacent said wall portion of slightly less dimension than said minor inner diameter region to effect wedging cooperation between the cone-shaped portion of the plunger unit and the cone-shaped neck portion thereby effecting a squeezing action tending to cause substantially all the product to be discharged from the body.

17. In a dispensing cartridge assembly that includes a hollow, generally cylindrical cartridge body for holding the product to be discharged, and a plunger unit axially slidably received within the body, the improvement wherein said body comprises a unitary structure having a first axial length section of substantially uniform inside diameter terminating at one end of the body, and a second axial length section extending from the first length section to the other end of the body; said second axial length section including a generally cone shaped neck portion having its minor inner diameter region adjacent said other end, and a transversely extending body closure wall portion defining said other end and having a central orifice opening in alignment with the axis of the body, said plunger unit comprising a body that includes a cylindrically shaped first portion of substantially axially uniform outside diameter that is substantially equal to said uniform inside diameter, said first portion terminating at one end of the unit, and a generally cone shaped portion extending from said first portion and terminating at the other end of the unit, and wherein said first axial length section of said body includes axially spaced inwardly projecting annular bulges adjacent said one end of the body to engage said first portion of the plunger unit therebetween in snap-fit relation.

18. In a dispensing cartridge assembly in accordance with claim 17 wherein said annular bulges comprise a first bulge region defining a circumambient ring of rounded surface configuration and a second bulge region defining a circumambient ring that includes a substantially flat transverse surface portion facing said first bulge region.

19. In a dispensing cartridge assembly in accordance with claim 18 wherein said body is of plastic material, the arcuate neck portion defines a radius of about one inch and the planar neck portion is offset from the transverse direction by an angle of about 12½ degrees.

* * * * *